United States Patent [19]

Tsao

[11] Patent Number: 4,783,867

[45] Date of Patent: Nov. 15, 1988

[54] MULTI-FUNCTIONAL STATIONERY TOOL COMBINATION

[76] Inventor: Dan-Chern Tsao, 6F-1, No. 283, An-Ho Road, Taipei, Taiwan

[21] Appl. No.: 114,610

[22] Filed: Oct. 30, 1987

[51] Int. Cl.[4] ..... B26B 11/00

[52] U.S. Cl. ..... 7/160; 7/119; 30/123

[58] Field of Search ..... 7/118–120, 7/160, 163; 30/123, 152, 155–163, 331, 335, 336, 142

[56] References Cited

U.S. PATENT DOCUMENTS 166,099 7/1875 Hastings ..... 7/119
1,828,121 10/1931 Adam et al. ..... 7/118 X
2,575,652 11/1951 Bover ..... 7/118 X
4,491,261 1/1985 Mitsuhashi ..... 7/160 X

FOREIGN PATENT DOCUMENTS 16853 7/1902 United Kingdom ..... 7/118

*Primary Examiner*—Douglas D. Watts
*Attorney, Agent, or Firm*—Angelo Notaro

[57] ABSTRACT

A multi-functional tool combination has a top and bottom casing and guiding plate which forms a compartment for the arrangement of a pair of scissors, a measuring tape, a stapler, a paper punch, a pencil sharpener, a blade etc. These stationery tools are adapted for convenient use, and the combination is compact so that it can be easily carried.

5 Claims, 4 Drawing Sheets

MULTI-FUNCTIONAL STATIONERY TOOL COMBINATION

BACKGROUND OF THE INVENTION

The present invention related generally to a multi-functional tool combination and more particularly to a stationary tool combination which includes measuring tape, scissors, punch, stapler and etc. for everyday office work purposes.

Conventionally, stationery tools such as staplers, measuring tapes, scissors, etc. are separately manufactured and used. This is comparatively inconvenient to office workers who frequently use these tools.

Even though dual function stationery tool combinations may be found currently, this is still insufficient for use in today's modern office. It often happens that one needs a particular stationery tool but that stationery tool is not around and time is wasted in looking for it.

SUMMARY OF THE PRESENT INVENTION

It is therefore the primary object of the invention to provide a multi-functional stationery tool combination which will alleviate the above-mentioned drawback.

It is an object of this invention to provide a multi-functional tool combination which is durable and inexpensive.

Another object of this invention is to provide a multi-functional tool combination wherein the stationery tools can easily be utilized.

A further object of the present invention is to provide a multi-functional stationery tool combination that is intended for office purposes and for students, and which is easily assembled and disassembled and may be produced at a very low cost.

Yet another object of this invention is to provide a multi-functional tool combination which is lightweight and can be easily carried, and one which does not occupy too much space.

A further object of the invention is to provide a multi-functional tool combination which is relatively economical and thus suited to the financial circumstances of students.

Some of the objects of the invention having been stated, other objects will appear as the description proceeds when taken in connection with the accompanying drawings.

DETAILED DESCRIPTION OF THE INVENTION

Figure 2:
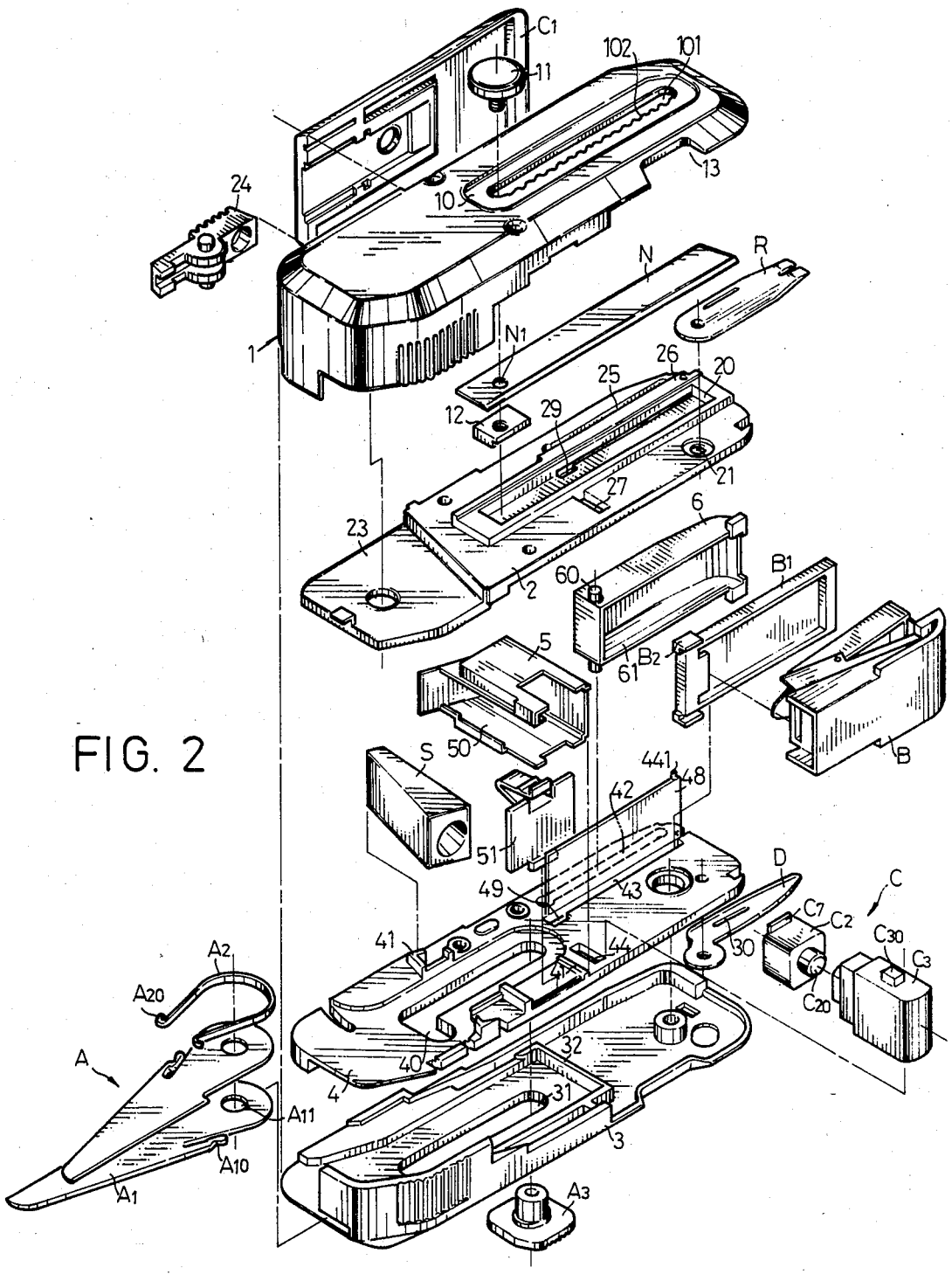
FIG. 2 is an exploded perspective view of a multi-functional tool combination in accordance with the present invention.

Referring to the drawings, more specifically to FIG. 2, which is a fragmentary perspective view of the present preferred embodiment, wherein there is shown the multi-functional stationery tool combination comprising four principle parts which are the top casing (1), top guiding plate (2), bottom casing (3) and bottom guiding plate (4).

As shown in FIG. 2, the top casing (1) has a rectangular shape. A horizontal depression (10) is provided on the surface of casing (1) and a long and narrow opening (101) having wave-like structure (102) at one of the longer edge therein is provided through casing (1).

Adjacent the bottom of the opening (101), is a recess (not shown) adapted to receive a blade (N) having a hole (N1) at one end thereof. By means of a roundhead fastening nut (11), the blade (N) is connected to a slidable base (12) with said fastening nut (11) extending through said opening (101) and hole (N1) of said blade (N). The blade (N) is therefore, closely received against the recess (not show) beneath said opening (101). The slidable base (12) is slidably provided on the top guiding plate (2) having protruding edge (20) on the surface thereof. The slidable base (12) is slidably engaged at one side of said protruding edge (20) so that the displacement of the blade (N) can be controlled. Further, a fixation hole (21) is provided such in plate (2) that a staple removing device (R) can be disposed by any fastening nut or screw, onto said top casing (1).

Figure 1:
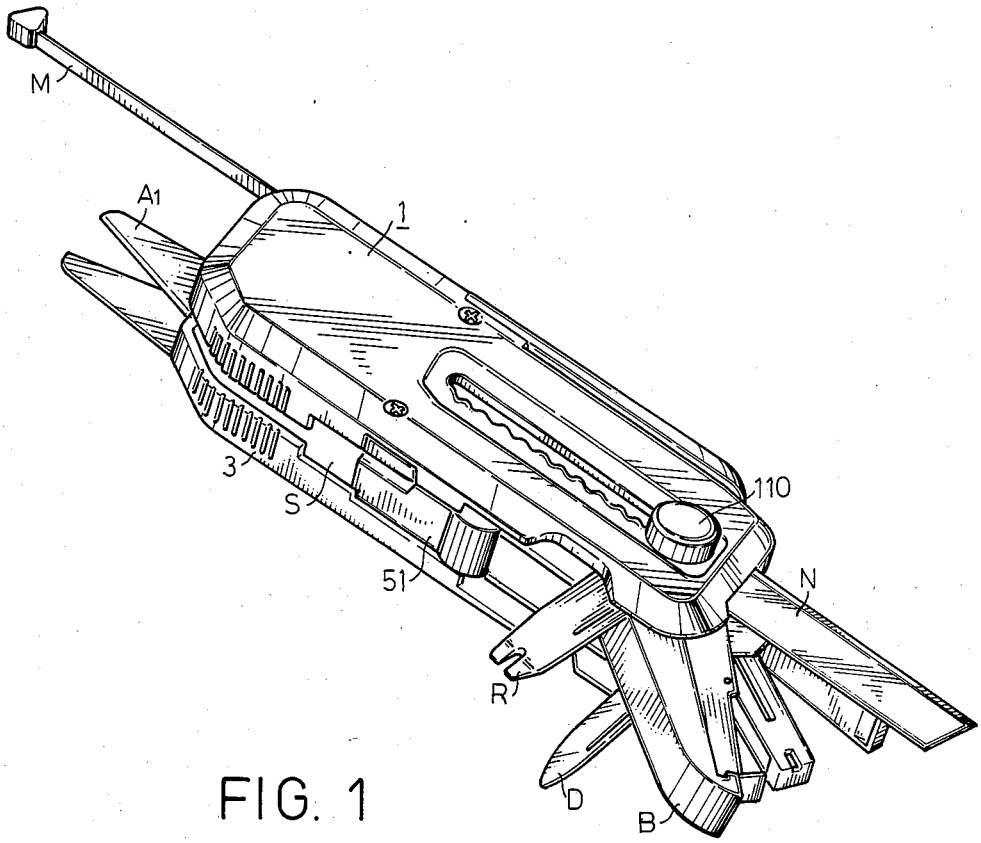
FIG. 1 is a perspective view of a multi-functional stationery tool combination of the present invention and illustrating the particular tool.

Reference is now made to FIG.2 and FIG. 1. A stepped platform (23) is formed on said top guiding plate (2), wherein a retractable measuring tape (M) (as shown in FIG. 1) is provided within a space formed in between said stepped platform (23) and the bottom of top casing (1). The action of the retractable measuring tape is controlled by a retrieving control element (24) such that when said tape (M) is extended, it can be returned to its original position.

Figure 3:
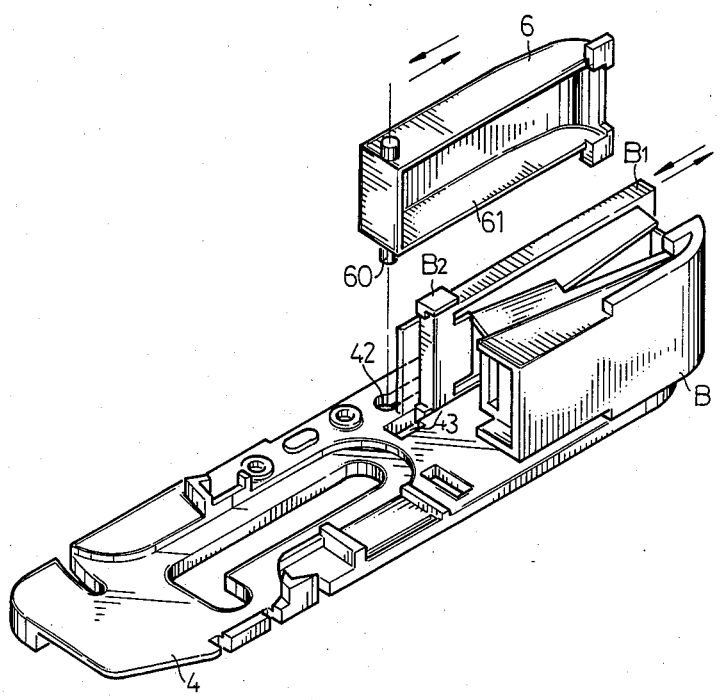
FIG. 3 is a partial exploded perspective view of a multi-functional tool combination showing the bottom casing with a stapler.

The bottom casing (3) and guiding plate (4) substantially have the same shape as that of the top casing (1) and guiding plate (2). An L-shaped opening (40) is provided on said bottom guiding plate (4). Adjacent to said opening (40), protruding element (41) are provided for the fixation of a pencil sharpener (S) having a container (5) for collecting pencil debris (not shown). The container (5) is open at one side (50) facing the debris dischanging side (not shown) of aid sharpener (S), such that the debris can be collected. When the collected debris is at a maximum amount, a slidable cover (51) provided on said bottom guiding plate (4) is slid out from said container (5) and thus, the debris can be dischanged. Further, two horizontal slots (42) (43) are provided adjacent the opening (40). Slots (42) and (43) correspond to the slots (25) and (26) of said top guiding plate (2). The pair of slots (42) and (25) is for the engagement of a storage box (6) having two protruding knobs (60) at one end thereof such that the storage box (6) can be slid in and out in the direction of the arrows as shown in FIG. 3. The storage box (6) is used to keep small articles such as pins or paper-clips, within an opening space (61) of said box (6). The pair of slots (43) and (26) is for the engagement of stapler (B) having engaging elements (B2) at the base (B1) thereof. The function of these slots (43), (26) are the same as that of slots (42), (25), therefore, the stapler (B) can be slid in and out within the slots (43), (26). A partition plate (48)

having protruding element (441) is provided adjacent the opening space (61) such that when the stapler (B) is withdrawn, articles within the opening space(61) will not be thrown out.

In between said stapler (B) and said container (5), a paper punch (C) is mounted. The punch (6) includes a base (C1) (top of FIG 2), a punching element (C2) and a pressing element (C3), wherein said base (C1) is substantially rectangular in shape and is mounted at the lateral edge of said top and bottom casings (1), (3). The punching element (C20) at the center of base element (C2), contacts the pressing element (C3) in order to punch a hole in paper. A pair of protruding blocks (C7) are each oppositely provided on the lower edge of said punching element (C2) so that said punching element (C2) can be firmly disposed on slits (29), (49) of said top guiding plate (2) and bottom guiding plate (4). One protruding block (C7) is respective fixed into each of the slits (29) and slit (49) which have the same thickness as that of said protruding blocks (C7). Two square shaped protrusions (C30) are provided on the lateral sides of said pressing element (C3) so that said element (C3) can be respectively engaged into a rectangular slot (44) of said bottom guiding plate (4) and a rectangular slot (27) of said top guiding plate (2), such that said pressing element (C3) is slidable within the slots (27), (44), when the pressing element (C3) is pressed down in a direction perpendicular to the base (C1), a hole will be made in a sheet of paper (not shown) in between said pressing means (C3) and said punching element (C20). Further more, a knife (D) is pivotally mounted onto said bottom guiding plate (4), such that knife (D) is mounted with an axis corresponding to the mounting axis of said stapler removing device (R). A depression (30) is made on said knife (D) so that said knife (D) can be easily extended about the axis of mounting.

Figure 4A:
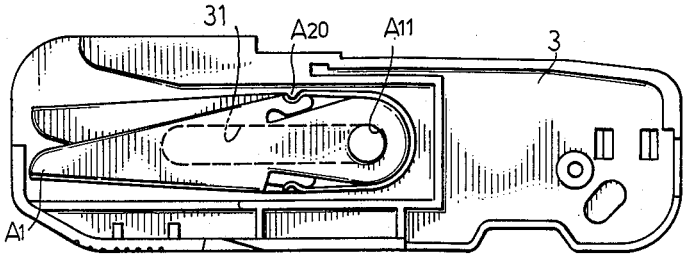
FIG. 4*a* is a sectional view of the present invention, illustrating the position of a pair of scissors.
Figure 4B:
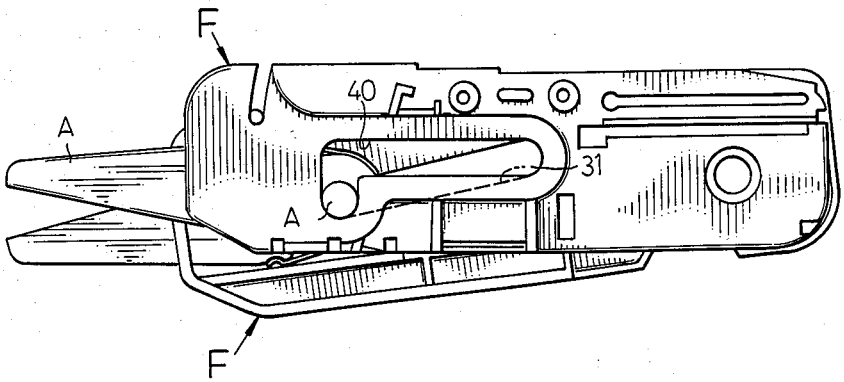
FIG. 4*b* is a another sectional view of the present invention, illustrating the operation of the pair of scissors which is slidably moved within a slot in the casing.

As shown in FIG. 2, a protruding periphery (32) is provided around a long opening (31). Periphery (32) has a certain thickness for the storage of a pair of scissors (A). As shown in the same figure, said pair of scissors (A) is formed from two scissor blades (A1) having a hole (A11) at one end thereof and a notch (A10) formed on the edge of said scissor blades (A1) near the one end. A U-shaped elastic spring (A2) having a hook (A20) at both ends thereof so that said spring (A2) can be engaged with said notch (A10) is provided on said scissor blades (A1). The scissors (A) is mounted to said L-shaped opening (40) of said bottom plate (4) by means of a fixation element (A3) after passing through said opening (A11) of said scissors blades (A1). As shown in FIG. 4A, the position of scissors (A) is within the periphery (32). The fixation element (A3) can be moved within the L-shaped opening (40), so that said scissors (A) is ready to be used as shown in FIG. 4B.

Referring again to FIG. 1, the present embodiment includes a pair of scissors (A), stapler (B), storage box (60), measuring tape (M), blade (N), staple removing devices (R) and knife (D), which can be separately used when desired.

In the drawings and specification there has been set forth a preferred embodiment of the invention and, although specific terms are employed, they are used in a generic and descriptive sense only and not for purpose of limitation, the scope of the invention being defined in the following claims.

I claim:

1. A multi-functional stationery tool combination, comprising:

a top casing (1), a bottom casing (3) connected to said top casing, a top guiding plate (2) connected between said top and bottom casings and a bottom guiding plate (4) connected between said top guiding plate and said bottom casing, said top casing having a narrow opening (101) therethrough, said top guiding plate having a protruding edge (20) thereon and a fixation hole (21) therethrough, said top guiding plate having a stepped platform (23) defining a measuring tape space with said top casing;

a slidable base (12) slidable mounted along said protruding edge;

a blade (N) mounted for sliding with said slidable base between said top casing and said top guiding plate;

fastening means (11) for connecting said slidable base to said blade, said fastening means having at least a portion extending through said narrow opening of said top casing for movement along said narrow opening for guiding the sliding movement of said blade;

a staple removing device (R) pivotally mounted to said fixation hole of said top guiding plate for pivotal movement on said top guiding plate;

measuring tape means (M) mounted in said measuring tape space for discharging and retrieving a measuring tape;

said bottom guiding plate including a plurality of protruding elements (41);

a pencil sharpener (S) engaged with at least one of said protruding elements of said bottom guiding plate for positioning said pencil sharpener on said bottom guiding plate;

a container (5) for receiving pencil sharpening debris, said container having an opening facing said sharpener and being engaged with at least one of said protruding elements of said bottom guiding plate for positioning said container on said bottom guiding plate;

said top and bottom guiding plates each having a first elongated slot (25, 42) with the first elongated slot of said bottom guiding plate extending parallel to the first elongated slot of said top guiding plate, said top and bottom guiding plates each having a second elongated slot (26, 43) with the second elongated slot of said top guiding plate extending parallel to the second elongated slot of said bottom guiding plate;

a storage box (6) having a protruding knob (6) slidably engaged in the first elongated slot of each of said top and bottom guiding plates for sliding movement of said storage box along said first elongated slots and between said top and bottom guiding plates;

a stapler (B) having an engaging element (B2) slidably engaged with said second elongated slot of each of said top and bottom guiding plates for sliding of said stapler along said second elongated slots and between said top and bottom sliding plates;

a paper punch (C) mounted between said top and bottom guiding plates for punching a hole in paper;

a knife (D) pivotally mounted to said bottom guiding plate;

said bottom guiding plate having an L-shaped opening (40) therethrough and said bottom casing having an elongated opening (31) therethrough with at least a portion of said L-shaped opening extending parallel to said elongated opening;

a fixation element (A3) slidably mounted along and between said L-shaped and elongated openings;

two scissor blades (A1) pivotally mounted to said fixation element and being slidable between a storage position between said bottom guiding plate and said bottom casing, and a use position extending from said bottom guiding plate and bottom casing with sliding movement of said fixation element along said elongated and L-shaped openings;

and spring means (A2) connected between said two scissor blades for biassing said scissor blades to spread when said scissor blades are in their use position extending out of said bottom guiding plate and said bottom casing.

2. The combination of claim 1 wherein said top casing includes a horizontal depression (10) extending around said narrow opening for receiving said fastening means, said fastening means comprising a fastening nut (11) connected to said slidable base and extending through an opening in said blade.

3. The combination of claim 1 wherein said paper punch comprises a base (C1) connected to said top and bottom casings, a punching element (C20) mounted between said top and bottom guiding plates and a pressing element (C3) mounted for movement between said top and bottom guiding plates for pressing said punching element to cooperate with said base to punch a hole in paper.

4. The combination of claim 1 wherein said bottom casing includes a protruding periphery (32) for receiving said two scissor blades in their storage position between said bottom guiding plate and said bottom casing, said spring means comprising an L-shaped elastic spring (A2) having opposite ends each engaged with one of said scissor blades.

5. The combination according to claim 1 including a partition plate (48) fixed between said top and bottom guiding plates and over said storage box for covering said storage box when said storage box is between said top and bottom guiding plates.

* * * * *